US005893012A

United States Patent [19]

Schubert et al.

[11] Patent Number: 5,893,012

[45] Date of Patent: Apr. 6, 1999

[54] APPARATUS AND METHOD FOR REMOVAL OF BACK-PLATED DEVELOPER

[75] Inventors: Troy D. Schubert, North Saint Paul, Minn.; James A. Baker, Hudson, Wis.

[73] Assignee: Imation Corp., Oakdale, Minn.

[21] Appl. No.: 24,533

[22] Filed: Feb. 17, 1998

[51] Int. Cl.[6] ..... G03G 15/10

[52] U.S. Cl. ..... 399/237; 399/249

[58] Field of Search ..... 399/237, 238, 399/239, 249; 15/256.51, 256.52

[56] References Cited

U.S. PATENT DOCUMENTS

| | | | |
|---|---|---|---|
| 3,955,533 | 5/1976 | Smith et al. | 399/249 |
| 5,035,178 | 7/1991 | Jahn et al. | 15/256.51 X |
| 5,570,164 | 10/1996 | Yamamoto et al. | 399/283 |
| 5,737,673 | 4/1998 | Lang et al. | 399/249 |
| 5,802,436 | 9/1998 | Lang et al. | 399/249 |

FOREIGN PATENT DOCUMENTS

| | | |
|---|---|---|
| 0 657 786 | 6/1995 | European Pat. Off. . |
| 63-075778 | 4/1988 | Japan . |

*Primary Examiner*—Matthew S. Smith
*Attorney, Agent, or Firm*—William D. Bauer

[57] ABSTRACT

An apparatus and method for removing back-plated developer from a development device in a liquid electrographic imaging system make use of a blade disposed to remove back-plated developer from the development device, and a brush disposed to remove the back-plated developer from the blade and redisperse the back-plated developer into a developer liquid supply. The brush includes a shaft and bristles disposed about the shaft. The shaft preferably is rotated to drive the bristles against the blade. In this manner, the bristles remove the back-plated developer from the blade and redisperse the back-plated developer within the developer liquid supply. The bristles can be formed from a substantially resilient material to generate a flicking action upon deflection and recovery. This flicking action facilitates redispersion of the back-plated developer into the developer liquid supply. The brush preferably is submerged in the developer liquid residing in the developer liquid supply, thereby avoiding significant drying of the developer liquid on the brush and significant splattering of the developer liquid by the brush. Submersion also enables the bristles to provide a churning action that aids in redispersion. The apparatus and method are capable of providing enhanced cleaning efficiency, as well as effective redispersion of back-plated developer for recovery and reuse. A bias potential can be applied to the brush to further aid in effective removal of back-plated developer.

42 Claims, 6 Drawing Sheets

APPARATUS AND METHOD FOR REMOVAL OF BACK-PLATED DEVELOPER

TECHNICAL FIELD

The present invention relates to liquid electrographic imaging technology and, more particularly, to techniques for removal of back-plated developer from a development device.

BACKGROUND INFORMATION

A liquid electrographic imaging system includes an imaging substrate onto which a developer liquid is delivered to develop a latent image. A liquid electrographic imaging system may include as the imaging substrate a dielectric substrate, or may take the form of an electrophotographic system having a photoreceptor. In an electrophotographic system, the photoreceptor includes a photoconductive material that is uniformly charged, for example, with a corona charging device. A latent image can be formed on the photoreceptor by selectively discharging the photoreceptor with a pattern of radiation. In an electrographic system that makes use of a dielectric material, the latent image can be formed by selectively charging the dielectric with an electrostatic probe. A liquid electrophotographic imaging system with a photoreceptor will be discussed for purposes of example.

A liquid electrophotographic imaging system generally includes a photoreceptor, an erasure station, a charging station, an exposure station, a development station, an image drying station, and a transfer station. The photoreceptor may take the form of a photoreceptor belt, a photoreceptor drum, or a photoreceptor sheet. For an imaging operation, the photoreceptor is moved past each of the stations in the liquid electrophotographic imaging system.

The erasure station exposes the photoreceptor to erase radiation sufficient to uniformly discharge any electrostatic charge remaining from a previous imaging operation. The charging station electrostatically charges the surface of the photoreceptor. The exposure station selectively discharges the surface of the photoreceptor to form a latent electrostatic image. A multi-color imaging system may include several exposure stations that form a plurality of latent images. Each of the latent images in a multi-color imaging system is representative of one of a plurality of color separation images for an original multi-color image to be reproduced.

As a latent image is formed, the development station applies developer liquid to the photoreceptor to develop the latent image. The developer liquid includes a carrier liquid and developer particles that form colorants. In a multi-color imaging system, each of a plurality of development stations applies an appropriately colored developer liquid to the photoreceptor to form an intermediate representation of the corresponding color separation image. The drying station dries the developer liquid applied by the development station or stations, leaving a film of developer material. The transfer station then transfers the developer material from the photoreceptor to an output substrate, such as a sheet of paper or film, to form a visible representation of the original image.

A development station generally includes a development device such as, for example, a development roller or belt. The operation of a development roller will be described for purposes of example. The development roller is rotated by a drive mechanism and charged with a bias potential that contributes to an electric field between the roller and the photoreceptor. The rotating, charged development roller delivers developer liquid to the surface of an imaging region of the photoreceptor to develop the latent image. The development roller typically is positioned a short distance from the surface of the photoreceptor, enabling a thin layer of developer liquid to be delivered across the resulting gap. In a multi-color imaging system, the development process is repeated with each of a plurality of development rollers applying differently colored developer liquids to the photoreceptor to develop different color separation images.

During operation, back-plated developer can accumulate on the surface of the development roller. The term "back-plated developer" refers to an amount of developer, including developer particles and perhaps a small amount of carrier liquid, that develops on the development roller due to a potential difference between the surface of the photoreceptor and the surface of the development roller. The developer liquid on the rotating development roller wets the surface of the photoreceptor, creating the development nip. When the imaging region of the photoreceptor enters the development nip, the background areas of the image are at an electrostatic potential slightly higher than the development roller bias and the latent image is at an electrostatic potential significantly lower than the development roller bias.

The potential difference between the development roller bias and the latent image results in "forward-plating" of developer to the latent image. The potential difference between the background areas and the development roller bias results in "back-plating" of developer to the surface of the development roller. The back-plated developer retains a small charge that, if allowed to accumulate, will affect the development vector necessary for proper image development. The accumulation of back-plated developer can cause inconsistent transfer of developer liquid to the surface of the photoreceptor. In addition, the back-plated developer can accumulate on other components in the development station, affecting delivery of developer liquid to the development roller.

To avoid excessive accumulation of back-plated developer on the development roller, it ordinarily is desirable to provide an apparatus for removing the back-plated developer. In existing liquid electrographic systems, the developer removal apparatus generally comprises a cleaning blade or cleaning roller. A cleaning blade scrapes developer away from the surface of the development roller. A cleaning roller is rotated to remove the back-plated developer from the development roller. The removed developer is carried away by the surface of the cleaning roller.

The back-plated developer removed from the development roller can accumulate on a cleaning blade or cleaning roller. The back-plated developer has a generally sludge-like consistency and can affect the cleaning efficiency of the cleaning blade or cleaning roller. When the accumulation becomes excessive, the cleaning blade or cleaning roller can actually transfer some of the accumulated developer back to the development roller, undermining the effectiveness of the developer removal apparatus. Excessive accumulation of back-plated developer requires replacement or cleaning of the cleaning blade or cleaning roller by a field service technician.

SUMMARY

The present invention is directed to an apparatus and method for removing back-plated developer from a development device such as a development roller or belt in a liquid electrographic imaging system. The apparatus and method are capable of providing enhanced cleaning efficiency, as well as effective redispersion of back-plated developer for recovery and reuse by the imaging system.

The apparatus and method, in accordance with the present invention, make use of a blade disposed to remove back-plated developer from the development device, and a brush disposed to remove the back-plated developer from the blade and redisperse the back-plated developer into a developer supply.

The brush may include a shaft and bristles disposed about the shaft. The shaft preferably is rotated to drive the bristles against the blade. In this manner, the bristles remove the back-plated developer from the blade and redisperse the back-plated developer within the developer supply for reuse. The bristles also may contact the surface of the development device.

The bristles can be formed from a resilient material to generate a flicking action upon deflection and recovery. This flicking action facilitates redispersion of the back-plated developer into the developer supply. The brush and blade preferably are submerged in the developer liquid residing in the developer liquid supply. In other words, the brush and blade are covered by developer liquid, thereby avoiding significant drying of the developer liquid on the brush and blade and significant splattering of the developer liquid by the brush.

As an alternative, the apparatus can be configured to incorporate only a brush that is oriented to remove back-plated developer from the development device and redisperse the back-plated developer into the developer liquid. In this case, the brush performs both the function of a blade, removing back-plated toner from the development device and the redispersion function. To avoid drying and splattering, the brush is submerged in the developer liquid.

As a further alternative, the apparatus can be configured to incorporate both the brush and the blade, but in an orientation in which the brush and blade substantially avoid contact with one another. The brush and blade can be oriented such that they both contact the surface of the development device. The brush and blade are displaced from one another, however, to avoid contact. In this case, preferably the brush and blade, but at least the brush, are submerged in the developer liquid.

In a first embodiment, the present invention provides an apparatus for removing back-plated developer from a development device in a liquid electrographic imaging system, the apparatus comprising a blade disposed to remove back-plated developer from the development device, and a brush disposed to remove the back-plated developer from the blade and redisperse the back-plated developer into a developer supply associated with the development device, wherein at least a portion of the brush is submerged in developer in the developer supply.

In a second embodiment, the present invention provides a system for developing an electrographic latent image formed on an imaging substrate with liquid developer, the system comprising a developer supply containing developer, a development device disposed to receive developer from the developer supply and transfer the developer to the imaging substrate, wherein a portion of the developer accumulates on the development device as back-plated developer, a blade disposed to remove the back-plated developer from the development device, a brush disposed to remove the back-plated developer from the blade and redisperse the back-plated developer into the developer supply, wherein at least a portion of the brush is submerged in the developer residing in the developer supply.

In a third embodiment, the present invention provides a method for removing back-plated developer from a development device in a liquid electrographic imaging system, the method comprising removing back-plated developer from the development device with a blade, and removing the back-plated developer from the blade and redispersing the back-plated developer into a developer supply with a brush, wherein at least a portion of the brush is submerged in developer residing in the developer supply.

In a fourth embodiment, the present invention provides an apparatus for removing back-plated developer from a development roller in a liquid electrographic imaging system, the apparatus comprising a blade having an edge disposed to remove back-plated developer from the development roller as the development roller rotates relative to the blade, a brush having a shaft and bristles disposed about the shaft, the brush being disposed to provide contact between the blade and at least some of the bristles, and a mechanism for rotating the shaft to drive the bristles against the development roller, the bristles thereby removing the back-plated developer from the blade and redispersing the back-plated developer into a developer liquid supply, wherein an entire developer removing portion of the brush is submerged in developer liquid residing in the developer liquid supply, thereby avoiding significant drying of the developer liquid on the brush and significant splattering of the developer liquid by the brush.

In a fifth embodiment, the present invention provides an apparatus for removing back-plated developer from a development device in a liquid electrographic imaging system, the apparatus comprising a developer liquid container containing developer liquid, and a brush disposed to remove back-plated developer from the development device and redisperse the back-plated developer into the developer liquid container, wherein at least a portion of the brush is submerged in the developer liquid in the developer liquid supply.

In a sixth embodiment, the present invention provides an apparatus for dispersing developer particles within a developer liquid contained in a developer liquid reservoir, the apparatus comprising a brush disposed within the reservoir, the brush including a shaft and bristles mounted about the shaft, wherein at least a portion of the bristles are submerged in the developer liquid in the reservoir, a mechanism for rotating the shaft to drive the bristles through the developer liquid, and a flicker member mounted within the reservoir for physical interaction with at least some of the bristles during rotation of the shaft, wherein the bristles are formed from a substantially resilient material, the bristles thereby generating a flicking action upon deflection and recovery due to physical interaction of the bristles with the flicker member, whereby the flicking action facilitates redispersion of the developer particles into the developer liquid.

Other advantages, features, and embodiments of the present invention will become apparent from the following detailed description and claims.

DESCRIPTION OF DRAWINGS

Like reference numbers and designations in the various drawings indicate like elements.

DETAILED DESCRIPTION

Figure 1:
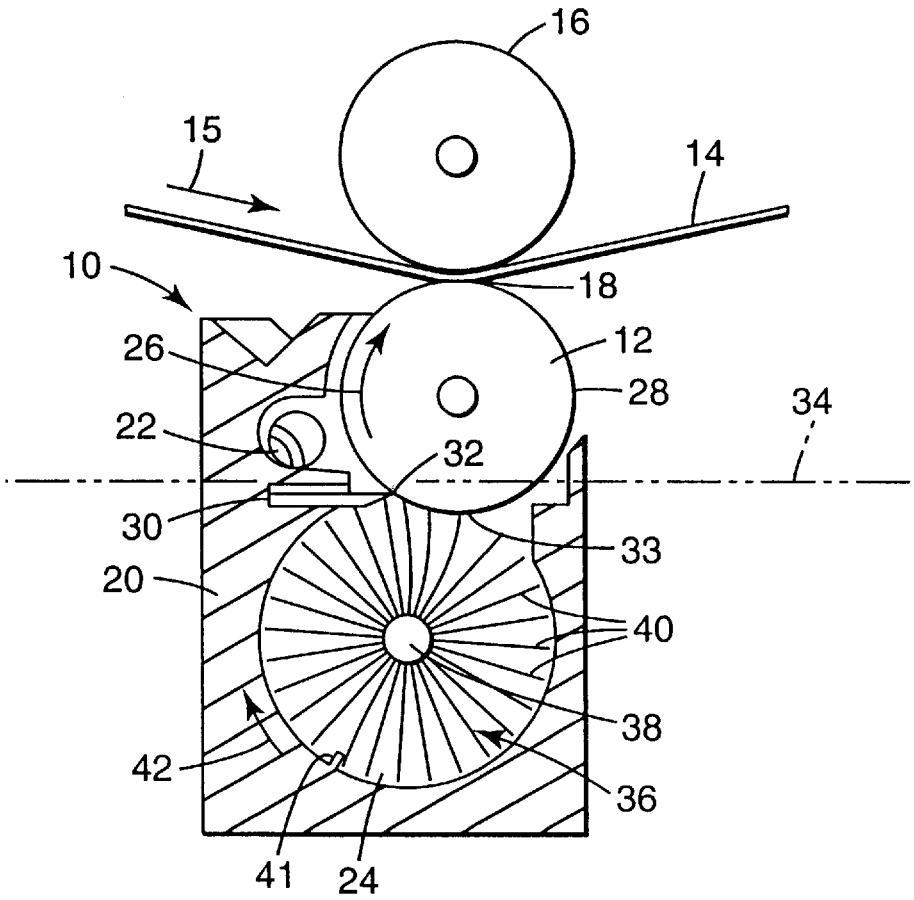
FIG. 1 is a cross-sectional side view of a development system incorporating an apparatus for removing back-plated developer.

FIG. 1 is a cross-sectional side view of a development system 10 incorporating an apparatus for removing back-plated developer in accordance with an embodiment of the present invention. For purposes of illustration, development system 10 will be described herein in terms of its application to electrophotographic imaging systems. Development system 10 may be readily applied, however, to liquid electrographic systems in general, including electrostatic systems that make use of dielectric substrates.

As shown in FIG. 1, development system 10 includes a development device in the form of a development roller 12 that applies developer liquid to a moving photoreceptor belt 14. The development device could be realized by alternative means such as a belt. Photoreceptor belt 14 carries a latent electrostatic image representative of an image to be developed. In the example of FIG. 1, photoreceptor belt 14 moves in a direction indicated by arrow 15. A backup roller 16 stabilizes photoreceptor belt 14 to form a development nip 18 with development roller 12. Development roller 12 is mounted in a developer module 20 and receives developer liquid from a developer liquid supply. In particular, development module 20 includes a plenum 22 that is in fluid communication with a reservoir 24 containing developer liquid. Developer liquid is transmitted from reservoir 24 to plenum 22 under pressure provided by a pump (not shown) associated with developer module 20.

As an alternative, plenum 22 may receive developer liquid from a separate supply reservoir. If a separate supply reservoir is provided, reservoir 24 may serve as a developer liquid recovery reservoir and be connected to provide recovered developer liquid to the supply reservoir. In either case, reservoir 24 forms part of the developer liquid supply circuit for development system 10. Plenum 22 transfers a thin film of developer liquid to the surface of development roller 12. A drive mechanism (not shown in FIG. 1) rotates development roller 12 in a direction indicated by arrow 26. Development roller 12 transfers the developer liquid film across nip 18 to develop the latent image on photoreceptor belt 14.

Development roller 12 is charged with a bias potential. The bias potential facilitates the transfer of developer liquid across nip 18 to photoreceptor belt 14. Specifically, the bias potential increases the electric field between development roller 12 and the discharged regions of the latent image for effective transport of developer particles. During operation, background areas of the latent image can acquire an electrostatic potential that is slightly higher than the potential of development roller 12. The resulting reverse bias field causes developer to transport from belt 14 back to development roller 12. This "back-plated" developer can accumulate on surface 28 of development roller 12 and, if not removed, undermine the development effectiveness of roller 12. In particular, significant accumulation of back-plated developer can cause inconsistent transfer of developer to photoreceptor belt 14. To avoid excessive accumulation of back-plated developer, development system 10 includes a skive blade 30.

Figure 2:
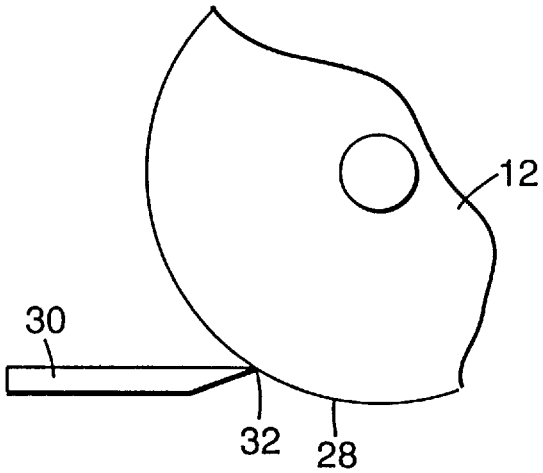
FIG. 2 is a partial view of the interface between a development roller and a blade in the system of FIG. 1.

Skive blade 30 is mounted within development module 20, and is oriented such that an edge 32 of the blade contacts surface 28 of development roller 12. In a preferred embodiment, blade 30 is submerged in developer liquid contained in reservoir 24. In other words, the developer liquid covers blade 30, or at least the portion of blade edge 30 in contact with surface 28 of developer roller 12. Thus, as shown in FIG. 1, the amount of developer liquid in reservoir 24 is maintained to a fill line 34 above blade 30. Alternatively, blade 30 could be oriented such that only the interface between blade edge 32 and development roller 12 is disposed below fill line 34. Edge 32 of blade 30 is oriented to work against surface 28 of the rotating development roller 12. Specifically, blade edge 32 can be positioned to oppose the direction of rotation of development roller 12. Also, as shown in FIG. 2, blade edge 32 can be shaped and oriented to provide a single edge surface that bears against surface 28 of development roller 12. In this manner, blade 30 produces a shearing action that serves to scrape back-plated developer away from the surface of development roller 12.

For effective scraping action, blade 30 preferably is oriented at an attacking angle relative to the surface of development roller 12. In other words, blade edge 32 is oriented to oppose the oncoming back-plated developer on surface 28 of development roller 12. Blade 30 can be formed from a variety of materials, but preferably comprises a resilient material that is capable of deflection and recovery in response to contact with developer roller 12. In this manner, blade 30 provides a spring-biased skiving action against surface 28 of development roller 12. Also, blade 30 should be inert to the particular developer liquid used system 10. Examples of suitable materials for blade 30 are polyester and nylon. Such materials are substantially resilient and non-reactive, particularly for developer liquids that include Norpar™ or Isopar™-based carrier liquids. Norpar and Isopar are trademarks that designate hydrocarbon solvents marketed by Exxon Corporation.

Much of the back-plated developer removed by blade 30 falls into the depths of reservoir 24. Submersion of blade 30 in developer liquid helps clean the blade, particularly for solvent-based developer liquids. Also, the developer liquid keeps blade 30 wet, thereby preventing the formation of a dry developer film on the blade surface during periods in which system 10 is not in use. Once the developer liquid has dried to form a film, it generally cannot be redispersed in a useful form back into the developer liquid supply. Despite submersion, some of the back-plated developer can accumulate on blade 30, leading to reduced cleaning efficiency if not removed. In addition, the back-plated developer that does not accumulate on blade 30 is not necessarily in a form that facilitates redispersion. In particular, the back-plated developer may include chunks of sludge-like developer. The developer that surrounds blade 30 may help loosen the back-plated developer. To better maintain the cleaning efficiency of blade 30 and provide enhanced redispersion, however, system 10 also incorporates a brush 36 in development module 20.

Brush 36 is disposed within reservoir 24 to remove back-plated developer from blade 30, and redisperse it into the developer supply for reuse. To accommodate brush 36, reservoir 24 may be substantially cylindrical in shape. As shown in FIG. 1, brush 36 takes the shape of a roller, and includes a shaft 38 and bristles 40 positioned about the shaft. The bristles 40 extend radially outward from shaft 38 into reservoir 24. Shaft 38 is rotated by a drive mechanism (not shown in FIG. 1) in a direction indicated by arrow 42, and is positioned such that bristles 40 physically interact with blade 30. Brush 36 could be rotated in the opposite direction, however, provided that bristles 40 continue to bear against blade 30 during movement to remove back-plated developer. If brush 36 is oriented such that bristles 40 also remove back-plated developer from development roller 12, rotation in the direction indicated by arrow 42 may be more desirable. Brush 36 and blade 30 are oriented to provide an overlap at the interface of the blade and surface 28 of development roller 12. The interference resulting from the overlap causes deflection of bristles 40. For effective cleaning operation, an overlap of approximately 0.060 inch (1.52 mm) between bristles 40 and blade 30 is sufficient. Such an overlap can be achieved by selecting the position of shaft 38 and the length of bristles 40.

Bristles 40 preferably are formed from a flexible but substantially resilient material. As bristles 40 move past the interface of blade 30 and development roller 12, they deflect and quickly recover. In this manner, bristles 40 produce a "flicking" action. As bristles 40 deflect, they scrape back-plated developer from blade 30 and surface 28 of development roller 12. During recovery, the flicking action of bristles 40 is effective in churning the developer liquid in reservoir 24 and breaking up the back-plated developer particles for redispersion. Thus, the flicking action restores the sludge-like developer to usable developer particles.

To enhance the flicking action, a flicker member 41 could be mounted within reservoir 24 to provide another surface for interference with bristles 40. Flicker member 41 could be formed, for example, from an elongated bar or angled flange that extends across reservoir 24 in a direction transverse to movement of brush 36. Flicker member 41 could be fastened to an inner wall of reservoir 24, for example, by screws, bolts, or welded bonds. Placement of flicker member 41 near the bottom of reservoir 24 may be particularly effective in redispersing any back-plated developer that may collect on the bottom. The use of brush 36 in combination with flicker member 41 could be used independently from the removal of back-plated developer from development roller 12. Specifically, brush 36 and flicker member 41 could support an independent dispersion or mixing operation that serves to periodically churn the developer solution in reservoir 24. For example, flicker member 41 could be mounted within reservoir 24 for physical interaction with at least some of bristles 40 during rotation of shaft 38. During rotation, bristles 40 thereby would generate a flicking action upon deflection and recovery due to physical interaction of the bristles with flicker member 41. The flicking action facilitates redispersion of the developer particles into the developer liquid.

Bristles 40 can be disposed about shaft 38 in a variety of patterns provided that the bristles make contact with substantially all of the interface between skive blade 30 and surface 28 of development roller 12. The selected pattern may provide continuous contact with the blade interface during rotation of brush 36. Alternatively, the pattern of bristles 40 can be selected to provide periodic contact as brush 36 is rotated. For example, bristles 40 may be disposed about shaft 38 in a spiral-like pattern, such as a substantially helical pattern.

Like blade 30, brush 36 preferably is submerged entirely in the developer liquid contained in reservoir 24. Brush 36 could be partially submerged, however, provided that bristles 40 are at least periodically submerged or otherwise wetted during use. The developer liquid is effective in loosening the back-plated developer that accumulates on bristles 40. The developer liquid also keeps bristles 40 wet, avoiding the formation of a dry developer film during periods in which system 10 is not in use. For example, it is conceivable that reservoir 24 could be drained during periods in which system 10 is inoperative. To avoid undesirable drying of developer films on blade 30 and brush 36 during such periods, reservoir 24 need not be hermetically sealed, but preferably is constructed to avoid significant evaporation. Thus, it is desirable that reservoir 24 be substantially closed at the interface between blade 30, brush 36, and development roller 12 to prevent vapor from escaping.

Complete submersion of brush 36 in the developer liquid prevents significant splattering that otherwise could result within developer system 10 from the flicking action generated by bristles 40. Thus, submersion of brush 36 and the interface between blade 30 and surface 28 of development roller 12 ensures cleaning effectiveness while eliminating the need for additional cleaning due to splattered developer liquid. Also, the avoidance of splattering minimizes waste of developer liquid. Instead, virtually all of the back-plated developer is redispersed and returned to reservoir 24 for reuse by development system 10.

As a further consideration, submersion of brush 36 enables bristles 40 to more effectively churn the developer liquid in reservoir 24. Specifically, the flicking action generated by bristles 40 provides a churning effect within the developer liquid as brush 36 is rotated. The churning effect further aids brush 36 in breaking up back-plated developer and redispersing it into the developer supply. The churning effect is assisted by the liquid solvent that carries the developer. Again, the wet solvent prevents the formation of dry developer films, and also loosens the back-plated developer removed by brush 36.

FIG. 1 provides a conceptual representation of a development system 10 for removing back-plated developer in accordance with an embodiment of the present invention. In this manner, FIG. 1 provides a conceptual understanding of the operation of development system 10. FIGS. 3–7 are schematic diagrams illustrating a particular implementation of the present invention.

Figure 3:
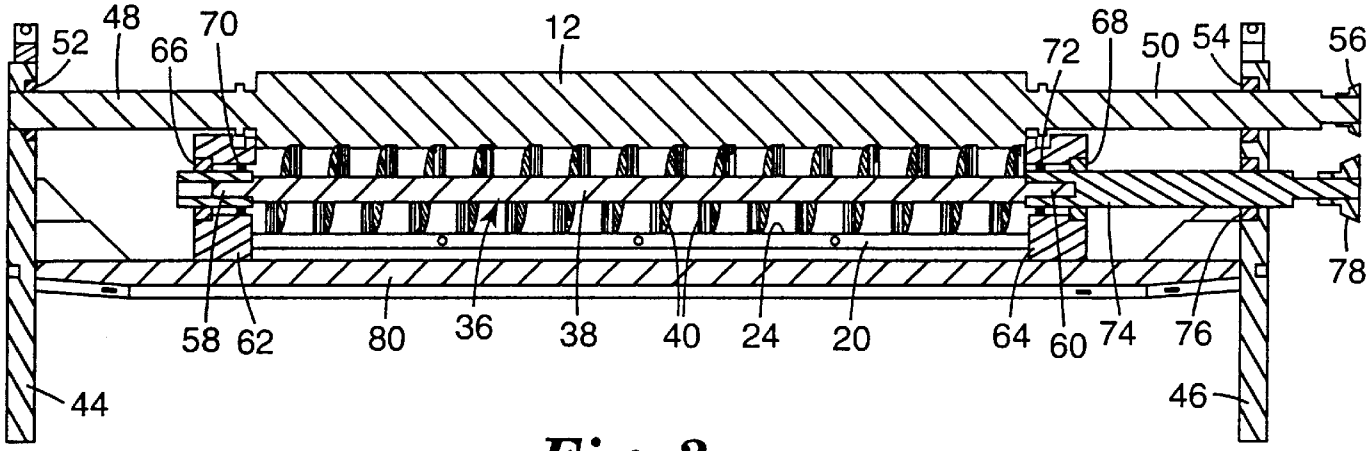
FIG. 3 is a cross-sectional front view of a development system constructed substantially as shown in FIG. 1.

FIG. 3 is a schematic cross-sectional front view of development system 10 constructed substantially as shown in FIG. 1. FIG. 3 shows development roller 12, reservoir 24, and brush 36. Blade 30 is not visible in FIG. 3. In FIG. 3, development module 20 includes in a pair of side plates 44, 46 for installation within an imaging system. Development roller 12 includes a shaft having ends 48, 50 mounted in bearings 52, 54, respectively, within side plates 44, 46. At one end 50, development roller 12 is coupled to a gear 56. Similarly, shaft 38 of brush 36 has opposite ends 58, 60 mounted in respective bearing blocks 62, 64. Bearing blocks 62, 64 have bearings 66, 68 and, to prevent significant leakage of developer liquid from reservoir 24, seals 70,72.

At one end 60, shaft 38 is coupled to a transmission shaft 74 mounted in a bearing 76 in side plate 46. Transmission shaft 74 is further coupled to a gear 78. Gears 56, 78 can be driven by a single drive mechanism such as an electric motor (not shown in FIG. 3), to drive development roller 12 and brush 36, respectively. A bottom plate 80 joins side plates 44, 46. Bottom plate 80 also forms a mounting surface for the bottom of reservoir 24. As shown in FIG. 3, bristles 40 may be disposed about shaft 38 in a substantially helical pattern. This pattern produces periodic contact of bristles 40 with development roller 12 and blade 30.

Figure 4:
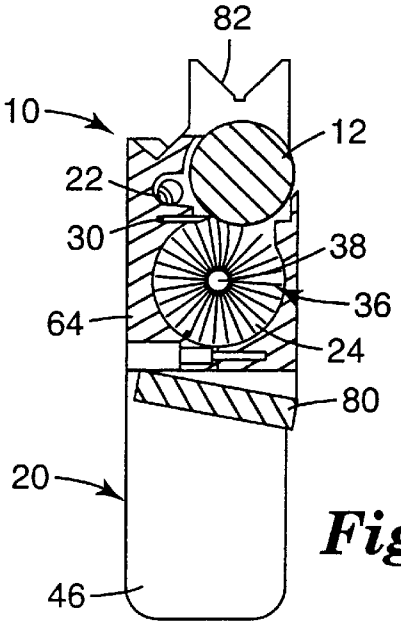
FIG. 4 is a cross-sectional side view of a development system as shown in FIG. 3.

FIG. 4 is a side view of development system 10 as shown in FIG. 3. FIG. 4 substantially conforms to FIG. 1 but further illustrates side plate 46 and bottom plate 80. FIG. 4 also illustrates a v-block 82 formed in side plate 46 to receive one end of a shaft associated with backup roller 16 (not shown in FIG. 4). A similar v-block is formed in side plate 44 for another end of the shaft for backup roller 16.

Figure 5:
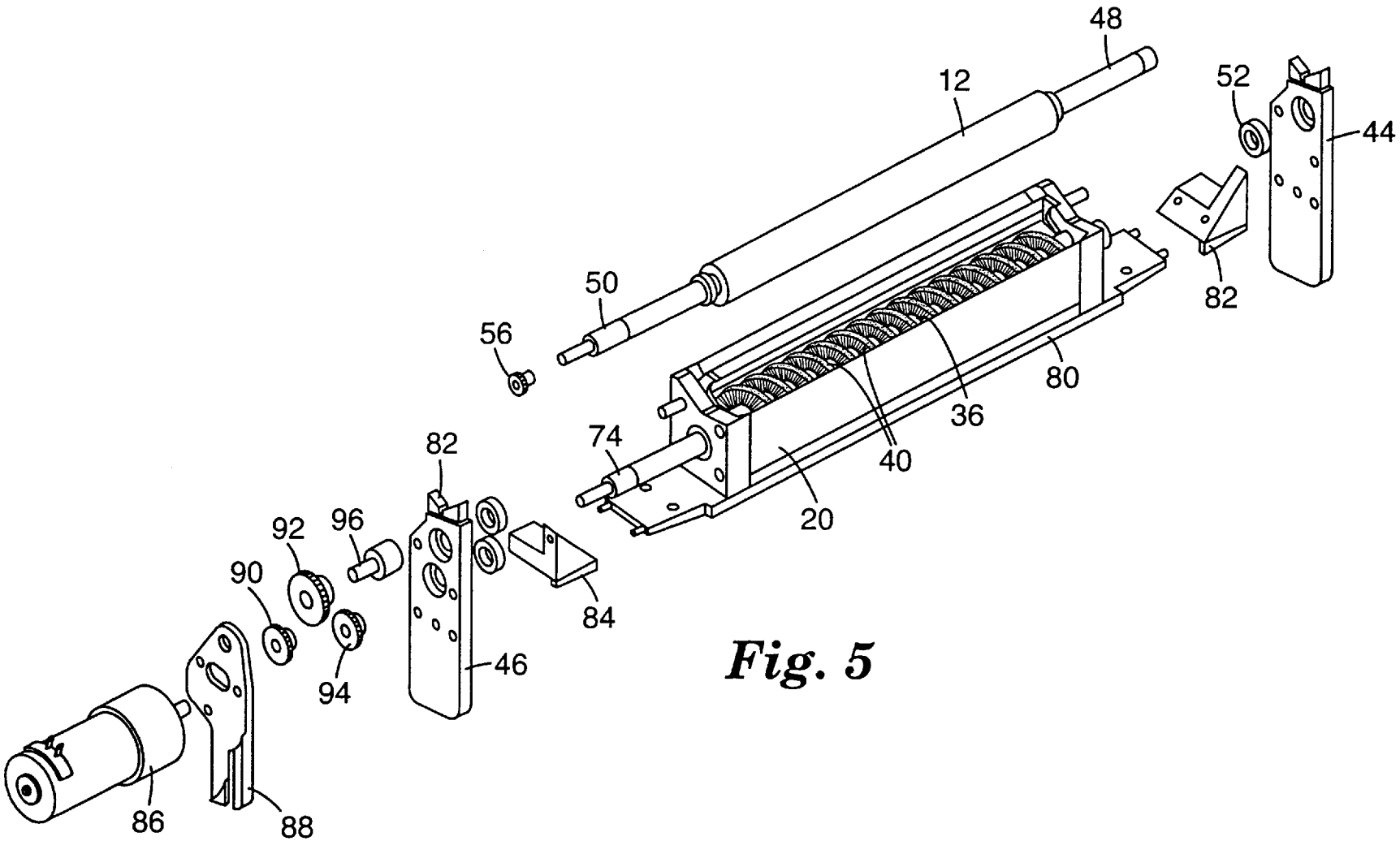
FIG. 5 is an exploded perspective view of a development system as shown in FIG. 3.

FIG. 5 is an exploded perspective view of development system 10 as shown in FIG. 3. As shown in FIG. 5, bottom plate 80 is attached to side plates 44, 46 via mounting brackets 82, 84, respectively. An electric motor 86 is mounted to side bracket 46 with a mounting bracket 88 and coupled to shaft ends 50, 74 of developer roller 12 and brush 36, respectively, by a series of gears and collars 90, 92, 94, 96.

Figure 6:
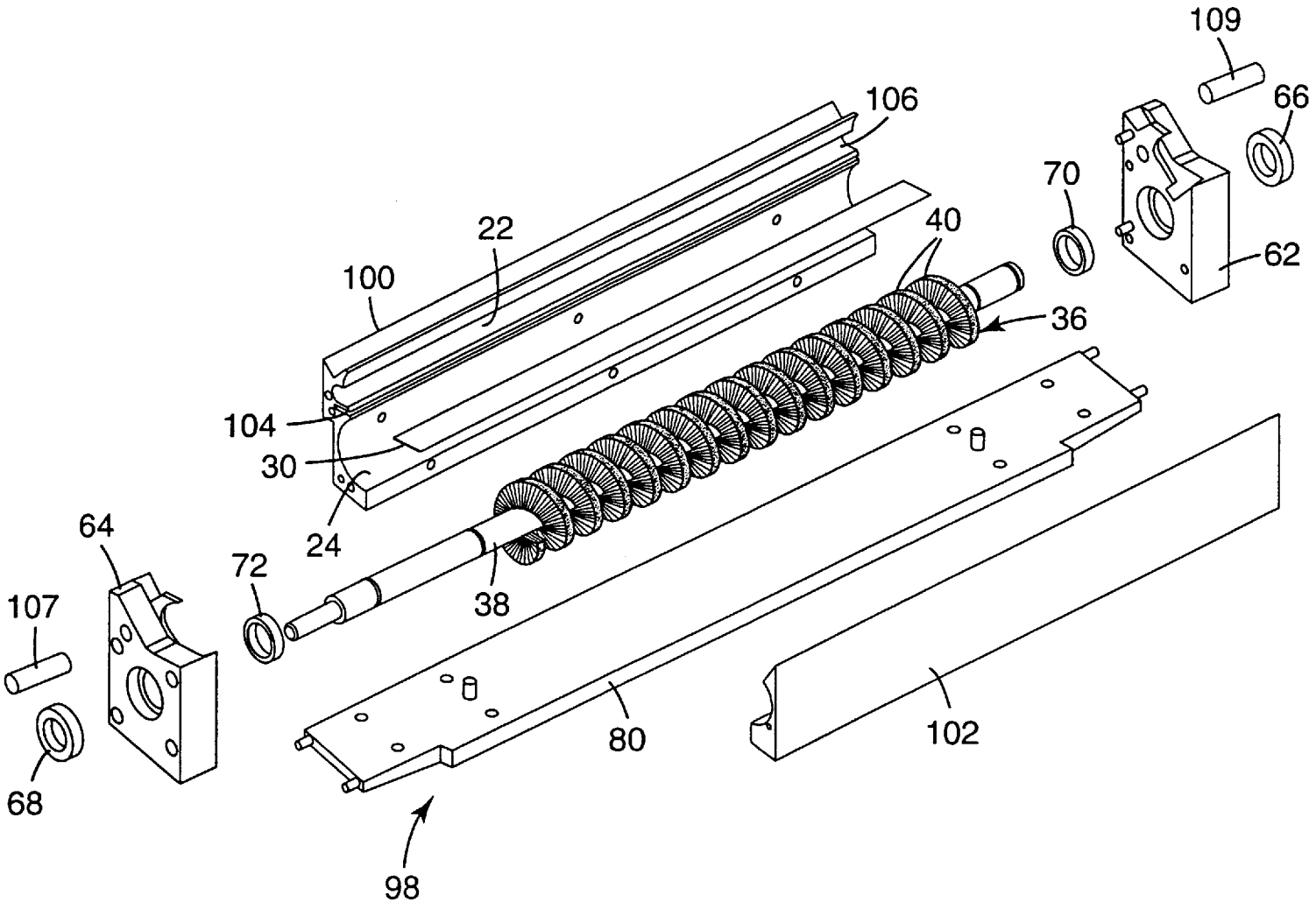
FIG. 6 is an exploded perspective view of a cleaner sub-system incorporated in a development system as shown in FIG. 3.

FIG. 6 is an exploded perspective view of a cleaner sub-system 98 incorporated in development system 10 of FIG. 3. Sub-system 98 includes blade 30 and brush 36, and defines reservoir 24. Specifically, reservoir 24 is enclosed by bearing blocks 62, 64, which form a first set of side walls, and a second set of side walls 100, 102. Blade 30 is mounted within a first groove 104 that extends along side wall 100, for example, by a series of screws. A second groove 106 defines plenum 22, which provides developer liquid to development roller 12. Fluid fittings 107, 109 deliver developer liquid from the developer supply, e.g., reservoir 24 or a separate supply reservoir, to fill plenum 22.

Blade edge 32 should extend continuously in a direction transverse to movement of development roller 12, and should have a length commensurate with the width of the region in which back-plated developer accumulates on the development roller. Also, the width of blade 30 in a direction extending outward from groove 104 should be selected, in view of the modulus of the blade material, to provide desired resilience for skiving. With a blade 30 made from polyester, for example, a thickness of approximately 0.016 inch (0.41 mm) and a width of approximately 0.5 inch (12.7 mm) has been observed to produce effective skiving operation. An example of a suitable blade 30 is the Esterlam synthetic laminate doctor blade type E350, commercially available from Esterlam International Limited, Devon, United Kingdom, which is made from polyester, has a width of approximately 0.5 inch (12.7 mm), and a thickness of approximately 0.016 inch (0.41 mm). The thickness and width dimensions of blade 30 appropriate for effective skiving will depend on the particular material and dimensions of the blade.

Figure 7:
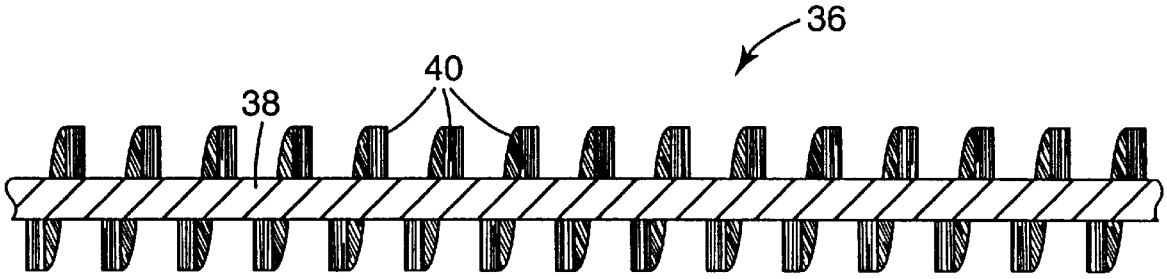
FIG. 7 is a partial cross-sectional view of a brush incorporated in a developer system as shown in FIG. 3.

FIG. 7 is a partial cross-sectional view of brush roller 36 incorporated in developer system 10 of FIG. 3. FIG. 7 illustrates, in particular, the formation of bristles 40 in a helical pattern about shaft 38. Brush roller 36 can be formed, for example, by spiral winding a bristle strip around shaft 38. As an illustration, the bristle strip may take the form of nylon fibers mounted on or embedded in a backer strip. In one embodiment, the nylon fibers may be selected to be approximately 0.006 inch (0.15 mm) in diameter and approximately 0.25 inch in length (6.4 mm). Shaft 38 can be approximately 0.25 inch in diameter (12.7 mm). With backer strip, bristles 40 and shaft 38 can produce an overall diameter of approximately 1 inch (25.4 mm). The particular dimension and materials chosen for the bristle strip will depend on internal dimensions and tolerances within developer system 10. The backer strip can be formed from stainless steel. The bristle strip can be mounted to shaft 38 by a variety of means including adhesives and mechanical fasteners such as screws. A brush roller 36 constructed in the above manner has been observed to provide effective cleaning of blade 30 as well as effective redispersion of back-plated developer.

Figure 8:
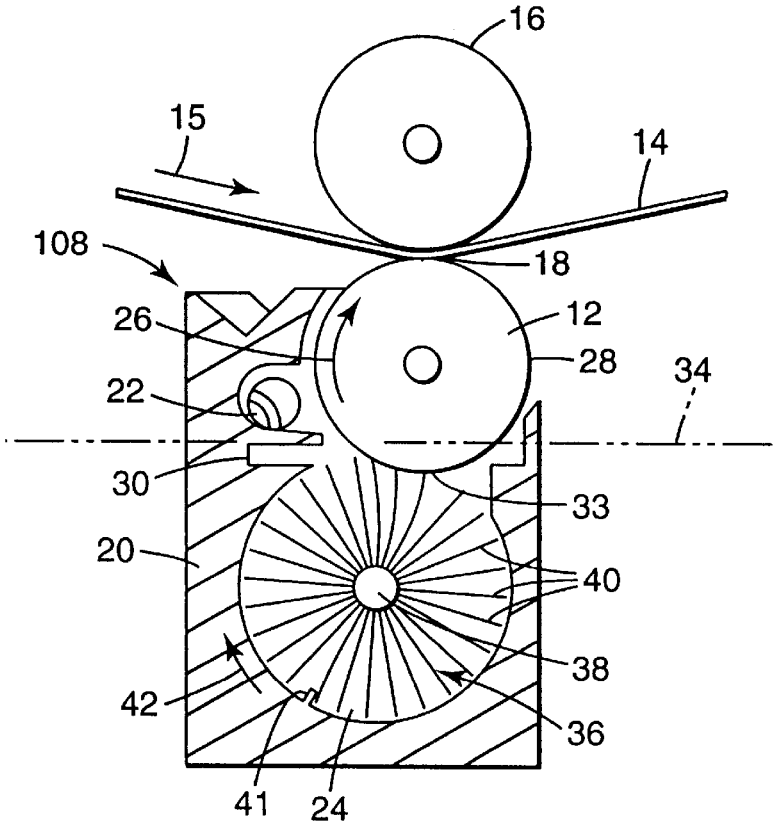
FIG. 8 is a cross-sectional side view of a development system incorporating an alternative embodiment of an apparatus for removing back-plated developer.

FIG. 8 is a cross-sectional side view of a development system 108 incorporating an alternative embodiment of an apparatus for removing back-plated developer. Development system 108 of FIG. 8 substantially conforms to system 10 of FIGS. 1–6, but does not require a blade. Instead, brush 36 serves to remove back-plated developer from surface 28 of development roller 12, and redisperse the back-plated developer into the developer liquid in reservoir 24. In this case, brush 36 performs the scraping function, but otherwise performs as illustrated and described with reference to FIG. 1. For example, in system 108, bristles 40 are submerged in the developer liquid contained in developer liquid reservoir 24. Also, bristles 40 are formed from a substantially resilient material, thereby generating a flicking action upon deflection and recovery due to physical interaction of the bristles with development roller 12 during rotation of shaft 38. Again, the flicking action facilitates redispersion of the back-plated developer into the developer liquid reservoir 24. At the same time, submersion of brush 36 in the developer liquid avoids significant drying of the developer liquid on the brush and significant splattering of the developer liquid by the brush. In this exemplary embodiment, brush 36 can be rotated in the direction indicated by reference numeral 42 to oppose the movement development roller 12. As an alternative, however, brush 36 could be rotated in the same direction as development roller 12 provided that the surface velocities of the brush and development roller are substantially different.

Figure 9:
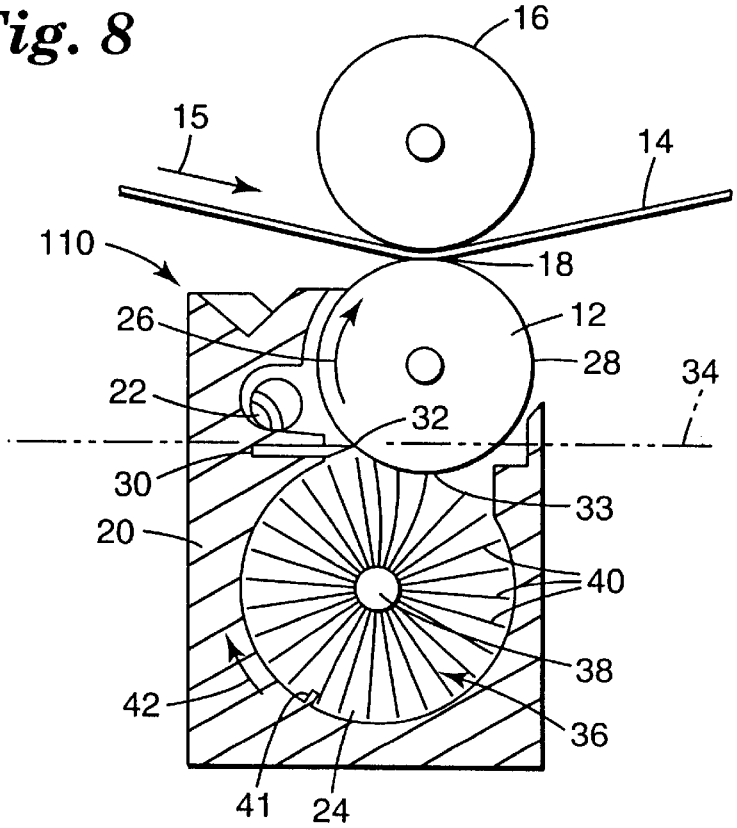
FIG. 9 is a cross-sectional side view of a development system incorporating another alternative embodiment of an apparatus for removing back-plated developer.

FIG. 9 is a cross-sectional side view of a development system 110 incorporating another alternative embodiment of an apparatus for removing back-plated developer. Development system 110 of FIG. 9 substantially conforms to system 10 of FIGS. 1–6, but is configured such that brush 36 contacts only surface 28 of development roller 12, and not blade 30. Thus, blade 30 removes back-plated developer from surface 28 of developer roller 12 for recovery by developer liquid reservoir 24. At the same time, brush 36 removes back-plated developer from surface 28 of development roller 12, and redisperses the back-plated developer. Thus, in the alternative embodiment of FIG. 9, blade 30 and brush 36 are oriented to avoid contact with one another.

Figure 10:
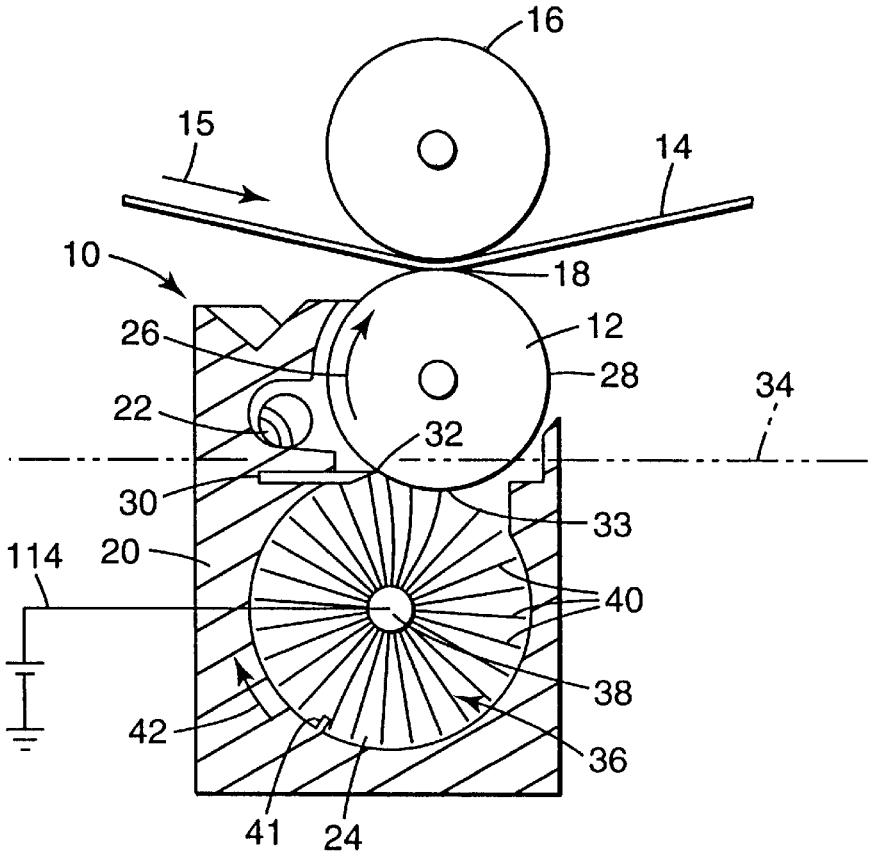
FIG. 10 is a cross-sectional side view of a development system incorporating another alternative embodiment of an apparatus for removing back-plated developer.

FIG. 10 is a cross-sectional side view of a development system 112 incorporating another alternative embodiment of an apparatus for removing back-plated developer. Development system 112 of FIG. 9 substantially conforms to system 108 of FIGS. 9, but further includes a power source 114 that delivers a bias potential to brush 36. In system 112, brush 36 is oriented to contact development roller 12 but may contact blade 30. The bias potential can be selected to create a potential difference between brush 36 and development roller 12, and a resultant electric field. In particular, the bias potential can be selected to create an electric field that facilitates transport of back-plated developer from development roller 12 to brush 36. The bias potential thereby enhances the cleaning efficiency of brush 36. To optimize removal and redispersion of back-plated developer, the bias potential could be sufficiently high to facilitate transport from development roller 12, but low enough to avoid significant retention of developer particles on brush 36 in response to the flicking action of bristles 40. As an alternative, the bias potential applied to brush 36 could be selected to match the potential applied to developer roller 12. In this case, the bias potential would result in a potential difference between brush 36 and development roller 12 of approximately zero. The electric field, if any, would thereby be minimal. This bias potential could be achieved by simply electrically coupling brush 36 and development roller 12 together, or at least to a common power source. Although the equalizing bias potential in this case would not actively facilitate the transport of back-plated developer, it would eliminate any potential difference that would lead to an electric field in the opposite direction. In other words, the equalizing bias potential would counteract any bias potential on development roller 12 that would tend to retain back-plated developer and prevent its removal. The bias potential would thereby substantially neutralize the electric field between development roller 12 and brush 36. In either case, the bias potential can be applied by a variety of means. For example, shaft 38 can be made from an electrically conductive metal and have at least a portion rotatably mounted about a conductive shaft or within a conductive sleeve that is coupled to a power source. Also, bristles 40 could be formed from an electrically conductive material such as aluminum or stainless steel.

The foregoing detailed description has been provided for a better understanding of the invention and is for exemplary purposes only. Modifications may be apparent to those skilled in the art without deviating from the spirit and scope of the appended claims.

What is claimed is:

1. An apparatus for removing back-plated developer from a development device in a liquid electrographic imaging system, the apparatus comprising:

a blade disposed to remove back-plated developer from the development device; and a brush disposed to remove the back-plated developer from the blade and redisperse the back-plated developer into a developer liquid supply associated with the development device, wherein at least a portion of the brush is submerged in developer liquid in the developer liquid supply.

2. The apparatus of claim 1, wherein the brush includes bristles disposed to remove the back-plated developer from the blade, the bristles being submerged in the developer liquid contained in the developer liquid supply.

3. The apparatus of claim 2, wherein the brush includes a shaft and the bristles are disposed about the shaft, the apparatus further comprising a mechanism for rotating the shaft to drive the bristles against the blade, thereby removing the back-plated developer from the blade and redispersing the back-plated developer within the developer liquid in the developer liquid supply.

4. The apparatus of claim 3, wherein the bristles are formed from a substantially resilient material, the bristles thereby generating a flicking action upon deflection and recovery due to physical interaction of the bristles with the blade as the shaft is rotated, whereby the flicking action facilitates redispersion of the back-plated developer into the developer liquid supply.

5. The apparatus of claim 4, wherein the development device comprises a development roller that is disposed in fluid communication with the developer liquid in the developer liquid supply, the developer liquid supply including a reservoir and a plenum, the reservoir containing the developer liquid and the plenum delivering the developer liquid to the development roller, and wherein the brush is submerged in the developer liquid contained in the reservoir.

6. The apparatus of claim 1, wherein the blade is submerged in the developer liquid residing in the developer liquid supply.

7. The apparatus of claim 1, wherein the brush is oriented to contact the development device, the apparatus further comprising means for applying a bias potential to the brush, the bias potential being selected to generate an electric field between the development device and the brush that facilitates transport of back-plated developer from the development device to the brush.

8. The apparatus of claim 1, wherein the brush is oriented to contact the development device, the apparatus further comprising means for applying a bias potential to the brush, the bias potential being selected to substantially neutralize an electric field between the development device and the brush.

9. A system for developing an electrographic latent image formed on an imaging substrate with a developer liquid, the system comprising:

a developer liquid supply containing developer liquid;

a development device disposed to receive developer liquid from the developer liquid supply and transfer the developer liquid to the imaging substrate, wherein a portion of the developer liquid accumulates on the development device as back-plated developer;

a blade disposed to remove the back-plated developer from the development device;

a brush disposed to remove the back-plated developer from the blade and redisperse the back-plated developer into the developer liquid supply, wherein at least a portion of the brush is submerged in the developer liquid residing in the developer liquid supply.

10. The system of claim 9, wherein an entire developer removing portion of the brush is submerged in the developer liquid residing in the developer liquid supply, thereby avoiding significant drying of the developer liquid on the brush and significant splattering of the developer liquid by the brush.

11. The system of claim 9, wherein the brush is entirely submerged in the developer liquid residing in the developer liquid supply.

12. The system of claim 11, wherein the brush comprises a shaft and bristles disposed about the shaft, and the system further comprises a mechanism for rotating the shaft to drive the bristles against the blade, thereby removing the back-plated developer from the blade and redispersing the back-plated developer within the developer liquid supply.

13. The system of claim 12, wherein the bristles are formed from a substantially resilient material, the bristles generating a flicking action upon deflection and recovery due to physical interaction of the bristles with the blade as the shaft is rotated, wherein the flicking action facilitates redispersion of the back-plated developer into the developer liquid supply.

14. The system of claim 13, wherein the development device comprises a development roller that is disposed in fluid communication with the developer liquid in the developer liquid supply, the developer liquid supply including a reservoir and a plenum, the reservoir containing the developer liquid and the plenum delivering the developer liquid to the development roller, and wherein the brush is submerged in the developer liquid contained in the reservoir.

15. The system of claim 9, wherein the blade is submerged in the developer liquid residing in the developer liquid supply.

16. The system of claim 9, wherein the brush is oriented to contact the development device, the system further comprising means for applying a bias potential to the brush, the bias potential being selected to generate an electric field between the development device and the brush that facilitates transport of back-plated developer from the development device to the brush.

17. The system of claim 9, wherein the brush is oriented to contact the development device, the apparatus further comprising means for applying a bias potential to the brush, the bias potential being selected to substantially neutralize an electric field between the development device and the brush.

18. A method for removing back-plated developer from a development device in a liquid electrographic imaging system, the method comprising:

removing back-plated developer from the development device with a blade; and removing the back-plated developer from the blade and redispersing the back-plated developer into a developer liquid supply with a brush, wherein at least a portion of the brush is submerged in developer liquid residing in the developer liquid supply.

19. The method of claim 18, further comprising submerging an entire developer removing portion of the brush in the developer liquid residing in the developer liquid supply, thereby avoiding significant drying of the developer liquid on the brush and significant splattering of the developer liquid by the brush.

20. The method of claim 18, further comprising submerging the entire brush in the developer liquid residing in the developer liquid supply.

21. The method of claim 18, wherein the brush comprises a shaft and bristles disposed about the shaft, and the method further comprises rotating the shaft to drive the bristles against the blade, thereby removing the back-plated developer from the blade and redispersing the back-plated developer within the developer liquid supply.

22. The method of claim 21, wherein the bristles are formed from a substantially resilient material, the bristles generating a flicking action upon deflection and recovery due to physical interaction of the bristles with the blade as the shaft is rotated, wherein the flicking action facilitates redispersion of the back-plated developer into the developer liquid supply.

23. The method of claim 22, wherein the development device comprises a development roller that is disposed in fluid communication with the developer liquid in the developer liquid supply.

24. The method of claim 23, wherein the developer liquid supply includes a reservoir and a plenum, the reservoir containing the developer liquid and the plenum delivering the developer liquid to the development roller, and wherein the brush is submerged in the developer liquid contained in the reservoir.

25. The method of claim 18, further comprising submerging the blade in the developer liquid residing in the developer liquid supply.

26. The method of claim 18, further comprising orienting the brush to contact the development device, and applying a bias potential to the brush, the bias potential being selected to generate an electric field between the development device and the brush that facilitates transport of back-plated developer from the development device to the brush.

27. The method of claim 18, further comprising orienting the brush to contact the development device, and applying a bias potential to the brush, the bias potential being selected to substantially neutralize an electric field between the development device and the brush.

28. An apparatus for removing back-plated developer from a development roller in a liquid electrographic imaging system, the apparatus comprising:

a blade having an edge disposed to remove back-plated developer from the development roller as the development roller rotates relative to the blade;

a brush having a shaft and bristles disposed about the shaft, the brush being disposed to provide contact between the blade and at least some of the bristles; and a mechanism for rotating the shaft to drive the bristles against the blade, the bristles thereby removing the back-plated developer from the blade and redispersing the back-plated developer into a developer liquid supply, wherein an entire developer removing portion of the brush is submerged in developer liquid residing in the developer liquid supply, thereby avoiding significant drying of the developer liquid on the brush and significant splattering of the developer liquid by the brush.

29. The apparatus of claim 28, wherein the bristles are formed from a resilient material, the bristles generating a flicking action upon deflection and recovery due to physical interaction of the bristles with the blade during rotation of the shaft, wherein the flicking action facilitates redispersion of the back-plated developer into the developer liquid supply.

30. The apparatus of claim 28, wherein the developer liquid supply includes a reservoir and a plenum, the reservoir containing the developer liquid and the plenum delivering the developer liquid to the development roller, and wherein the brush is submerged in the developer liquid contained in the reservoir.

31. The apparatus of claim 28, wherein the blade is submerged in the developer liquid residing in the developer liquid supply.

32. The apparatus of claim 28, wherein the brush is oriented to contact the development roller, the apparatus further comprising means for applying a bias potential to the brush, the bias potential being selected to generate an electric field between the development roller and the brush that facilitates transport of back-plated developer from the development roller to the brush.

33. The apparatus of claim 28, wherein the brush is oriented to contact the development roller, the apparatus further comprising means for applying a bias potential to the brush, the bias potential being selected to substantially neutralize an electric field between the development device and the brush.

34. An apparatus for removing back-plated developer from a development device in a liquid electrographic imaging system, the apparatus comprising:

a developer liquid container containing developer liquid; and a brush disposed to remove back-plated developer from the development device and redisperse the back-plated developer into the developer liquid container, wherein at least a portion of the brush is submerged in the developer liquid in the developer liquid container.

35. The apparatus of claim 34, wherein the brush includes bristles disposed to remove the back-plated developer from the development device, the bristles being submerged in the developer liquid contained in the developer liquid container.

36. The apparatus of claim 35, wherein the brush includes a shaft and the bristles are disposed about the shaft, the apparatus further comprising a mechanism for rotating the shaft to drive the bristles against the development device, thereby removing the back-plated developer from the development device and redispersing the back-plated developer within the developer liquid in the developer liquid container.

37. The apparatus of claim 36, wherein the bristles are formed from a substantially resilient material, the bristles thereby generating a flicking action upon deflection and recovery due to physical interaction of the bristles with the development device as the shaft is rotated, whereby the flicking action facilitates redispersion of the back-plated developer into the developer liquid in the developer liquid container.

38. The apparatus of claim 34, further comprising a blade disposed to remove back-plated developer from the development device, the brush and blade being oriented to substantially avoid contact with one another.

39. The apparatus of claim 38, wherein the blade is submerged in the developer liquid in the developer liquid container.

40. The apparatus of claim 34, wherein the brush is oriented to contact the development device, the apparatus further comprising means for applying a bias potential to the brush, the bias potential being selected to generate an electric field between the development device and the brush that facilitates transport of back-plated developer from the development device to the brush.

41. The apparatus of claim 34, wherein the brush is oriented to contact the development device, the apparatus further comprising means for applying a bias potential to the brush, the bias potential be selected to substantially neutralize an electric field between the development device and the brush.

42. An apparatus for dispersing developer particles within a developer liquid contained in a developer liquid reservoir, the apparatus comprising:

a brush disposed within the reservoir, the brush including a shaft and bristles mounted about the shaft, wherein at least a portion of the bristles are submerged in the developer liquid in the reservoir;

a mechanism for rotating the shaft to drive the bristles through the developer liquid; and a flicker member mounted within the reservoir for physical interaction with at least some of the bristles during rotation of the shaft, wherein the bristles are formed from a substantially resilient material, the bristles thereby generating a flicking action upon deflection and recovery due to physical interaction of the bristles with the flicker member, whereby the flicking action facilitates redispersion of the developer particles into the developer liquid.

* * * * *